US005875375A

United States Patent [19]

Ohmori et al.

[11] Patent Number: 5,875,375

[45] Date of Patent: Feb. 23, 1999

[54] ELECTROPHOTOGRAPHIC APPARATUS AND PROCESS CARTRIDGE

[75] Inventors: Hiroyuki Ohmori, Mishima; Shintetsu Go, Yokohama; Kunihiko Sekido, Susono, all of Japan

[73] Assignee: Canon Kabushiki Kaisha, Tokyo, Japan

[21] Appl. No.: 968,263

[22] Filed: Nov. 12, 1997

[30] Foreign Application Priority Data

Nov. 12, 1996 [JP] Japan ..... 8-314164

[51] Int. Cl.[6] ..... G03G 15/00; G03G 15/04

[52] U.S. Cl. ..... 399/159; 399/111; 430/66; 430/69; 430/902

[58] Field of Search ..... 399/159, 161, 399/111; 430/56, 60, 31, 66, 69, 902, 126

[56] References Cited

U.S. PATENT DOCUMENTS

| | | | |
|---|---|---|---|
| 5,384,625 | 1/1995 | Anayama et al. | 399/159 |
| 5,434,027 | 7/1995 | Oshiba et al. | 430/126 X |
| 5,732,313 | 3/1998 | Kawada et al. | 430/902 X |

FOREIGN PATENT DOCUMENTS

| | | |
|---|---|---|
| 0576203 | 12/1993 | European Pat. Off. . |
| 0615177 | 9/1994 | European Pat. Off. . |
| 56-104351 | 8/1981 | Japan . |
| 57-178267 | 11/1982 | Japan . |
| 58-139156 | 8/1983 | Japan . |
| 58-150975 | 9/1983 | Japan . |
| 63-149668 | 6/1988 | Japan . |
| 3-9380 | 1/1991 | Japan . |
| 5-034964 | 2/1993 | Japan . |

*Primary Examiner*—S. Lee

*Attorney, Agent, or Firm*—Fitzpatrick, Cella, Harper & Scinto

[57] ABSTRACT

An electrophotographic apparatus is constituted by an electrophotographic photosensitive member, a charging member, developing device and transfer device. The charging member is disposed contactable to the photosensitive member and supplied with a voltage so as to charge the photosensitive member. The photosensitive member includes a metal support, a photosensitive layer disposed on the support, and a surface layer disposed on the photosensitive layer. The surface layer has a volume resistivity of $1\times10^{10}$–$1\times10^{15}$ ohm.cm, and the metal support has a surface-oxidized film at its surface provided with the photosensitive layer. The use of the above surface layer and the above metal support in combination is effective in stably performing good injection charging.

18 Claims, 2 Drawing Sheets

ELECTROPHOTOGRAPHIC APPARATUS AND PROCESS CARTRIDGE

FIELD OF THE INVENTION AND RELATED ART

The present invention relates to an electrophotographic apparatus and a process cartridge, particularly those for injection charging.

Hitherto, in an electrophotographic process, using a photosensitive member, including steps of, e.g., charging, exposure, development, transfer, fixing and cleaning; the charging step has been generally performed by utilizing corona discharge applying a high DC voltage of 5–8 kV to a metal wire. The corona discharge, however, has generated corona products such as ozone and NOx to degrade the photosensitive member surface, thus causing an image blur and accelerating a deterioration in electrophotographic characteristics. Further, the staining of the wire has caused defective images with white dropout and black streaks.

Particularly, an electrophotosensitive member having a photosensitive layer comprising an organic photoconductor (OPC) has a chemical stability lower than a selenium photosensitive member and an amorphous photosensitive member, so that the OPC photosensitive member is liable to cause chemical reaction (principally oxidation reaction) when exposed to the corona products, thus resulting in a deteriorated photosensitive member. Accordingly, when the OPC photosensitive member is repetitively charged by the corona discharge, the photosensitive member causes the image blur and lowering of a photosensitivity due to the above-mentioned deterioration and a lower image density of a copied image due to an increase in residual potential, thus being liable to shorten the life of the photosensitive member in repetitive use.

Further, the corona charger (charger using corona discharge) is a charging means having a poor charging efficiency since a current flowing toward the photosensitive member is merely 5–30% of the entire current and most of the entire current passes through a sealed plate.

In order to solve the above-mentioned problems, there have been proposed contact charging processes as described in Japanese Laid-Open Patent Applications (JP-A) 57-178267, 56-104351, 58-139156 and 58-150975. In these processes, a DC voltage of ca. 1–2 kV is externally applied to a charging member, such as an electroconductive elastic roller, contacting the surface of the photosensitive member, thus charging the photosensitive member surface at a prescribed potential.

However, the contact charging processes are disadvantageous in some respects, such as nonuniform charging and an occurrence of dielectric breakdown of the photosensitive member due to the discharging when compared with the above-mentioned corona discharging process. The nonuniform charging causes a phenomenon such that a streak-like charging irregularity portion (e.g., 200 mm in length and 0.5 mm in width) is generated and observed in a direction perpendicular to the moving (rotating) direction of the photosensitive member. As a result, such a charging irregularity portion leads to image defects, such as a white streak (within a solid black or halftone image) in a normal development and a black streak in a reversal development.

In order to improve a uniformity in charging, there has been proposed a charging method wherein a voltage obtained by superposing an AC voltage on a DC voltage is applied to a charging member as described in JP-A 63-149668.

However, if the superposed AC voltage is increased to prevent the image defects, a maximum applied-voltage of a resultant pulsating voltage becomes large, thus being liable to cause the dielectric breakdown at a slight defect portion within the photosensitive member. Particularly, this tendency is noticeable in the case of using an OPC photosensitive member providing a low withstand (dielectric proof) voltage. When once the dielectric breakdown is caused, the photosensitive member lowers its surface potential along a longitudinal direction of its contact portion with the charging member. Further, the contact charging is effected based on discharge at a minute spacing in the vicinity of the contact portion between the photosensitive member and the charging member. More specifically, the contact charging is effected by ionizing molecules in the ambient air and passing the resultant ions through the photosensitive member surface.

In this case, the ions move within a large electric field, thus considerably damage the photosensitive member. As a result, the photosensitive member causes a large amount of abrasion and lowers its durability.

Further the contact charging also causes the occurrence of ozone or NOx although the degree of the occurrence is far less than the case of the corona discharging, so that there is a possibility that the image blur is caused to occur depending on operating conditions.

In view of the above problems, a so-called injection charging method wherein charging is performed by contact-charging a photosensitive member having a medium-resistance surface layer (e.g., a resin layer in which electroconductive particles are dispersed) to directly inject an electric charge into the surface layer substantially without causing discharge has been proposed as described in European Patent Applications (EP-A) (publication numbers) EP-A-0576203 and EP-A-0615177.

By the contact charging method, the charging irregularity due to discharge is removed and the damage on the photosensitive member is decreased, thus enhancing the durability of the photosensitive member. In addition, almost no ozone and NOx are generated and the occurrence of, e.g., image blur is prevented, thus largely improving the above-described problems.

In such an injection charging method described above, however, when the superposed AC voltage is excessively applied or an electrical resistance (or resistivity) of the surface layer is too high even within the extent not causing the discharge, the resultant image is accompanied with fogs in some cases.

This problem is a particular technical problem, for the injection charging, which cannot arise in the ordinary contact charging utilizing discharge.

SUMMARY OF THE INVENTION

An object of the present invention is to provide an electrophotographic apparatus and a process cartridge, capable of stably performing good charge injection.

Another object of the present invention is to provide an electrophotographic apparatus and an process cartridge, allowing more latitude in designing for stably performing good injection charging.

According to the present invention, there is provided an electrophotographic apparatus, comprising: an electrophotographic photosensitive member, a charging member, developing means and transfer means; the charging member being disposed contactable to the photosensitive member and supplied with a voltage so as to charge the photosensitive member, wherein the photosensitive member comprises a metal support, a photosensitive layer disposed on the support, and a surface layer disposed on the photosensitive layer, the surface layer has a volume resistivity of $1\times10^{10}$–$1\times10^{15}$ ohm.cm, and the metal support has a surface-oxidized film at its surface provided with the photosensitive layer.

According to the present invention, there is also provided a process cartridge, comprising: an electrophotographic photosensitive member, and charging member disposed contactable to the photosensitive member and supplied with a voltage so as to charge the photosensitive member, wherein the photosensitive member comprises a metal support, a photosensitive layer disposed on the support, and a surface layer disposed on the photosensitive layer, the surface layer has a volume resistivity of $1\times10^{10}$–$1\times10^{15}$ ohm.cm, the metal support has a surface-oxidized film at its surface provided with the photosensitive layer, and the photosensitive member and the charging member are integrally supported to form a cartridge which is detachably mountable to an electrophotographic apparatus.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The electrophotographic apparatus and process cartridge according to the present invention include an electrophotographic photosensitive member and a contact charging member as a charging means.

The photosensitive member comprises a metal support, a photosensitive layer disposed on the metal support and a surface layer disposed on the photosensitive member. The surface layer has a volume resistivity (Rv) of $1\times10^{10}$–$1\times10^{15}$ ohm.cm, and the metal support includes a surface-oxidized film at its surface located on a side of the photosensitive layer.

Figure 1:
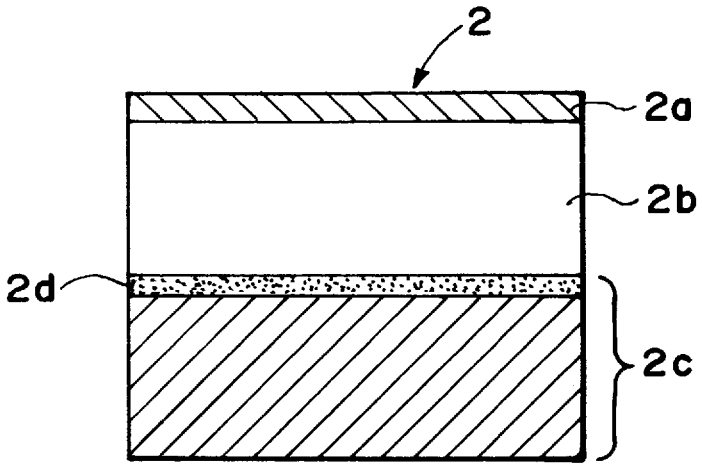
FIG. 1 is a schematic sectional view showing an embodiment of a layer structure of a photosensitive member used in the present invention.

FIG. 1 shows a schematic sectional view of such a photosensitive member structure.

Referring to FIG. 1, a photosensitive member 2 includes a surface layer 2*a,* a photosensitive layer 2*b,* and a metal support 2*c* including a surface-oxidized film 2*d.*

In the present invention, the volume resistivity (Rv=$1\times10^{10}$–$1\times10^{15}$ ohm.cm) of the surface layer of the photosensitive member may preferably be $1\times10^{11}$–$1\times10^{14}$ ohm.cm, more preferably $1\times10^{11}$–$5\times10^{12}$ ohm.cm.

If the Rv is below $1\times10^{10}$, electric charge is not readily retained sufficiently in ai high-humidity environment, thus being liable to cause image flow. Above $1\times10^{15}$ ohm.cm, electric charge cannot readily be sufficiently injected from the charging member.

Herein, the volume resistivity (Rv) of the surface layer are based on values measured in the following manner.

A surface layer is formed on a platinum (Pt)-deposited PET film and subjected to measurement of a volume resistivity by using a volume resistivity measurement apparatus ("4140B pAMATER", available from Hewlett-Packard Co.) under application of a DC voltage of 100 volts in an environment of 23° C. and 65% RH.

The surface layer may be formed as an inorganic layer, such as a metal vapor-deposition layer, or a resin layer containing electroconductive particles dispersed therein. Such an inorganic layer may be formed by vapor deposition, and a conductive particles-dispersed resin layer may be formed by an appropriate coating method, such as dipping, spraying, roller coating or beam coating. Further, the surface layer can also be formed with a mixture or copolymer of an insulating resin and a light-transmissive resin having a high ion-conductivity, or a photoconductive resin having a medium resistivity alone. In order to constitute the conductive particle-dispersed resin layer, the electroconductive particles may preferably be added in an amount of 2–250 wt. %, preferably 2–190 wt. %, of the binder resin. Below 2 wt. %, a desired volume resistivity cannot be readily obtained and, above 250 wt. %, the surface layer is caused to have a lower film strength and is therefore liable to be worn out by scraping, thus resulting in a short life of the photosensitive member. Further, the resultant resistance is lowered, thus being liable to cause image failure due to flow of a latent image potential.

The binder resin of the surface layer may comprise a material identical to that used for its underlying layer (e.g., charge transport layer). In this case, however, there is a possibility that a coating face of the underlying layer is disturbed during the coating step of the surface layer, so that it is necessary to particularly select an appropriate coating method.

The electroconductive particles dispersed in the binder resin of the surface layer may for example comprise particles of zinc oxide, titanium oxide, tin oxide, antimony oxide, indium oxide, bismuth oxide, indium oxide doped with tin, tin oxide doped with tantalum, tin oxide doped with antimony and zirconium oxide. These may be used singly or in combination of two or more species.

The binder resin of the surface layer may comprise commercially available resins, such as polyester, polycarbonate, polyurethane, acrylic resin, epoxy resin, silicone resin, alkyd resin and vinyl chloride-vinyl acetate copolymer. Further, in order to improve a strength distribution and a dispersibility, it is preferred to form a surface layer by dispersing the electroconductive particles in a photocurable acrylic monomer having at least two acryloyl groups in one molecule and applying the dispersion onto the photosensitive layer, followed by curing with light irradiation. As a result, the resultant surface layer is further improved in both the film strength and the dispersibility of the electroconductive particles.

The surface layer may preferably further contain lubricant particles, so that a contact (charging) nip between the photosensitive member and the charging member at the time of charging becomes enlarged thereby due to a lowered friction therebetween, thus providing an improved charging performance. The lubricant powder may preferably comprise a fluorine-containing resin, silicone resin or polyolefin resin having a low critical surface tension. Polytetrafluoroethylene (PTFE) resin is further preferred. In this instance, the lubricant powder may be added in 2–50 wt. %, preferably 5–40 wt. %, of the binder resin. Below 2 wt. %, the lubricant is insufficient, so that the improvement in charging performance is insufficient. Above 50 wt. %, the image resolution and the sensitivity of the photosensitive member are remarkably lowered in some cases.

The surface layer may preferably have a thickness of 0.1–10 μm, particularly 1–7 μm.

The metal support used in the present invention may preferably have a work function (Wf:eV) of 5.0–6.5, preferably 5.5–6.0. Below 5.0, a fog is liable to occur, and above 6.5, a sufficient surface potential is not readily obtained.

The work function (Wf) of the metal support including the surface-oxidized film is determined based on analysis of the metal support from the side of the surface-oxidized film by measuring photoelectron excited by ultraviolet (UV) rays in an ambient air through a low-energy photoelectron measurement apparatus (Surface Analyzer "Model AC-1", mfd. by Riken Keiki K.K.).

The surface-oxidized film constituting the metal support having the above-described work function (Wf) may preferably be formed by treating a metal support material in accordance with anodizing (anodic oxidation or treatment) or chemical oxidation.

The metal support material may comprise any metallic material having an electroconductivity. In the present invention, the metal support may preferably comprise aluminum and aluminum alloy, examples of which may include (pure) aluminum and aluminum alloys, such as Al—Mn alloy, Al—Mg alloy, Al—Cu alloy, Al—Si alloy, Al—Mg—Si alloy and Al—Cu—Si alloy. These aluminum and aluminum alloys may, e.g., include these according to JIS A1050, 1070, 1080, 3003 and 6063.

The anodizing as one of the treating methods for forming the surface-oxidized film on the metal support material surface may be performed in the following manner.

An aqueous solution of, e.g., oxalic acid, sulfuric acid, chromic acid or boric acid is used as an electrolysis solution. Depending on the kind of the electrolysis solution, anodic oxidation is performed under appropriate conditions including an applied voltage of 10–150 V, a current density of 0.1–500 $A/m^2$ and an appropriate treating time.

On the thus-formed surface-oxidized film through the anodizing, although the photosensitive layer may be formed immediately after the anodizing but may preferably be formed after a pore-filling treatment of the surface-oxidized film since the above-prepared surface-oxidized film is generally a porous layer which is susceptible to soiling and has an insufficient corrosion resistance.

Such a pore-filling treatment may be performed in accordance with known methods including a water-vapor (steam) treatment, a boiling water treatment, a nickel acetate treatment with a solution containing nickel acetate and cobalt acetate, a dichromate treatment with a dichromate solution containing, e.g., potassium dichromate, a sodium silicate treatment with a sodium silicate solution, fat and oil treatment through dipping or wet-coating of, e.g., oleic acid or stearic acid, and a resin impregnation (filling) treatment through dipping or wet-coating of, e.g., silicone resin or phenolic resin. Among these treating methods, the nickel acetate treatment capable of effectively filling minute pores based on hydration reaction may preferably be used.

The chemical oxidation is a chemical treatment in contrast with the anodizing being an electrical (electrochemical) treatment.

More specifically, the chemical oxidation may generally be performed by, e.g., immersing or dipping the metal support in a treating solution without using electric energy to form a surface-oxidized film containing a component of the treating solution on the surface of the metal support material.

For example, the chemical oxidation may include: chromating (chromate treatment) with an acid solution (as the treating solution) containing, e.g., chromic acid, a fluorine compound, phosphoric acid and oxidizing agent; and boehmite treatment with boiled water or water vapor.

The above-ranged work function of the metal support may preferably be provided by the above-described anodizing or chemical oxidation. More specifically, the above-described work function range may be obtained by appropriately controlling various treating factors, such as components of the electrolysis solution and the treating solution, the current density, the treating temperature, the treating time, the thickness of the oxidized film and conditions for the pore-filling treatment.

The photosensitive layer in the present invention may have a single layer structure or a lamination structure. In the case of the photosensitive layer having the single layer structure, generation and transfer (movement) of charge carriers are performed within the same layer. In the case of the photosensitive layer having the lamination structure, a charge generation layer for generating charge carriers and a charge transport layer for transporting the carriers are laminated.

The single layer-type photosensitive layer may preferably have a thickness of 5–100 μm, particularly 10–60 μm, and may preferably contain a charge generating material and a charge transporting material in a total amount of 20–80 wt. %, particularly 30–70 wt. %, based on the entire weight of the photosensitive layer.

The lamination-type photosensitive layer may preferably include a charge generation layer having a thickness of at most 5 μm, particularly 0.01–1 μm and a charge transport layer having a thickness of 5–100 μm, particularly 5–60 μm. Further, the charge generation layer may preferably contain the charge generating material in an amount of 10–100 wt. %, particularly 40–100 wt. % based on the entire weight of the charge generation layer. The charge transport layer may preferably contain the charge transporting material in an amount of 20–80 wt. %, particularly 30–70 wt. % based on the entire weight of the charge transport layer.

Examples of the charge generating material may include: organic substances, such as phthalocyanine pigments, azo pigments, perylene pigments, quinacridone pigments, azulenium salt pigments, pyrylium dyes, thiopyrylium dyes, squalium dyes, cyanine dyes, xanthene dyes, quinoneimine dyes, triphenylmethane dyes, and styryl dyes; and inorganic substances, such as selenium, selenium-tellurium, amorphous silicon, cadmium sulfide and zinc oxide.

Examples of the charge transporting material may include: hydrazone compounds, pyrazoline compounds, styryl compounds, oxazole compounds, thiazole compounds, triarylmethane compounds and polyarylalkane compounds.

Examples of a binder resin generally used for forming these layers may preferably include: acetal resin, acrylic resin, styrene resin, polyester, polycarbonate, polyarylate, polysulfone, polyphenylene oxide, epoxy resin, polyurethane and alkyd resin, although they are not particularly limited.

In the present invention, the photosensitive layer may optionally contain various additives, such as an antioxidant, an ultraviolet ray-absorbing substance (UV absorber) and a lubricant.

The charging member used in the electrophotographic apparatus (or process cartridge) according to the present invention may comprise a magnetic brush including magnetic particles forming ears erected on a sleeve, a fur brush, a charging roller and a charging plate. These may be selected appropriately depending on the electrophotographic apparatus used.

The magnetic brush may comprise various magnetic particles, such as Zn—Cu ferrite particles, a non-magnetic electroconductive sleeve for supporting the magnetic particles, and a magnetic roller enclosed within the sleeve.

The fur brush may comprise a polymer treated with an electroconductive material, such as carbon, copper sulfide, metal or metal oxide. Examples of the polymer may include rayon, acrylic resin, polypropylene, polyethylene terephthalate (PET) and polyethylene. These electroconductivity-imparted polymer constituting the fur is wound about or bonded to a core metal or another core material subjected to electroconductivity-imparting treatment, thus forming a fur brush.

The charging member may preferably have a resisttance of $1\times10^{0}$–$1\times10^{12}$ ohm, more preferably $1\times10^{2}$–$1\times10^{10}$ ohm.

The resistance of the charging member is determined based on values obtained from a current value passing therethrough when a DC voltage of 100 V is applied thereto by contacting an aluminum cylinder instead of the photosensitive member otherwise under identical conditions for actual operation.

By using the charging member and the photosensitive member in combination as described above, a charge initiation voltage (threshold voltage) Vth can be lowered and the photosensitive member charge potential can be increased and converged to a value which is almost 90% or above a DC component of the applied voltage to the charging member. For example, under ordinary charging condition (e.g., under application of a DC voltage of 100–2000 volts), it has become possible to effect an injection charging such that the photosensitive member having the surface layer (according to the present invention) is charged to a potential which is at least 80%, preferably at least 90%, of a voltage applied to the charging member. On the other hand, the charge potential obtained through the conventional charging utilizing the corona discharge has been almost zero V under application of a voltage of at most 640 V, and merely a value obtained by subtracting 640 V from an applied voltage under application of a voltage above 640 V.

Hereinbelow, a preferred embodiment of the electrophotographic apparatus and process cartridge according to the present invention will be described.

Figure 2:
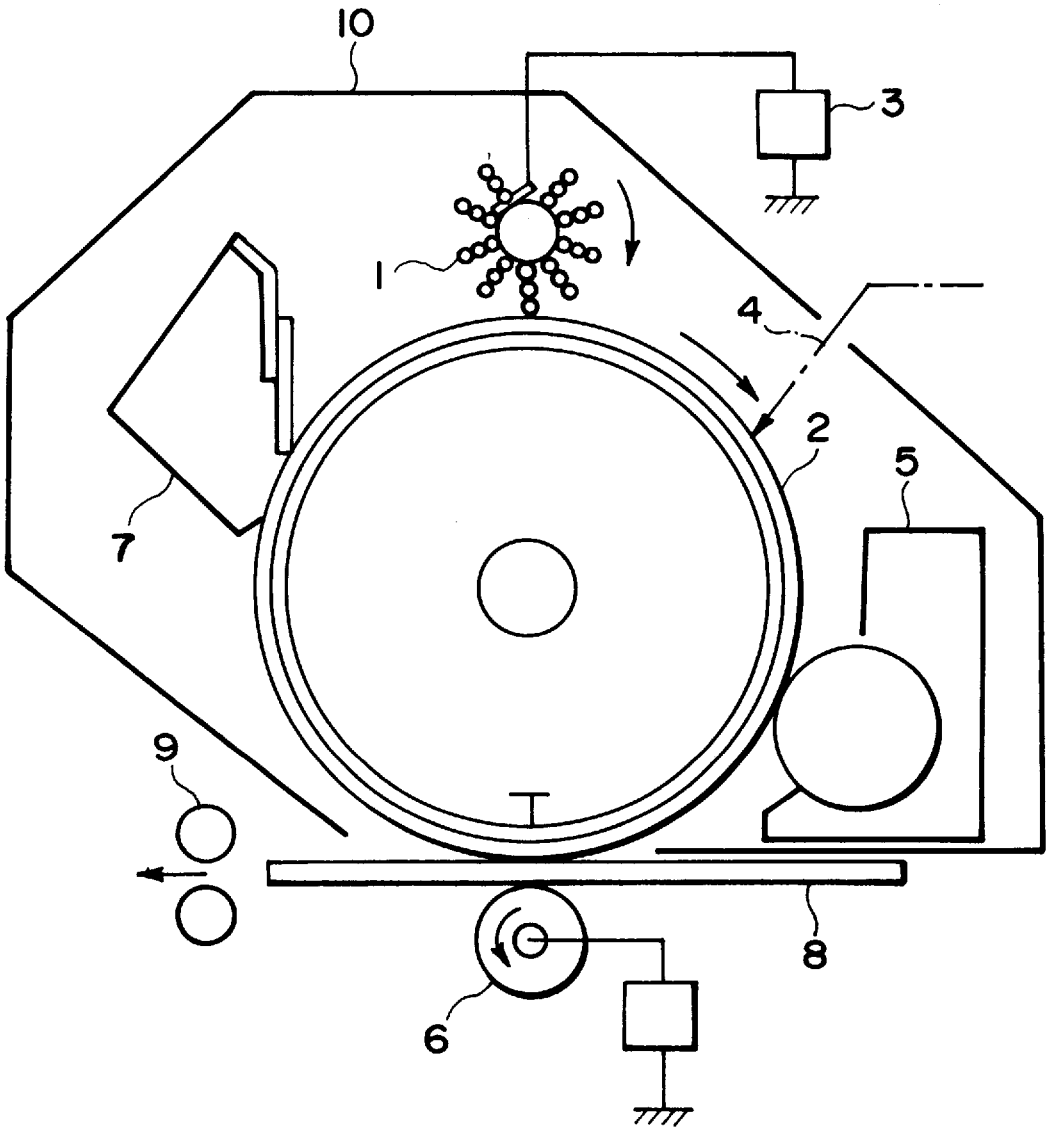
FIG. 2 is a schematic illustration of an embodiment of an electrophotographic apparatus including a process cartridge according to the present invention.

FIG. 2 is a schematic sectional view of the electrophotographic apparatus including the process cartridge of the present invention.

Referring to FIG. 2, the electrophotographic apparatus includes an electrophotographic photosensitive member 2 around (the peripheral surface) which a charging member 1 of a magnetic brush-type, developing means 5, transfer means 6 and cleaning means 7 are disposed in this order opposite to the photosensitive member 2.

Image formation is generally performed in the following manner.

The charging member 1 disposed contactable to the photosensitive member 2 is supplied with a voltage from a power supply 3 to charge the surface of the photosensitive member 2 so as to have a prescribed potential. The charged photosensitive member surface is exposed to imagewise exposure light 4 to form thereon an electrostatic latent image. Then, the electrostatic latent image formed on the photosensitive member 2 is developed (or visualized) by attaching a toner within the developing means 5 to the photosensitive member surface, thus forming a toner image. The toner image is then transferred onto a transfer-receiving material 8 (e.g., paper) supplied from, e.g., a paper-supply part (not shown) by using the transfer means 6. The residual toner, remaining on the photosensitive member 2, which has not been transferred onto the transfer receiving material 8 is recovered by the cleaning means 7. In the case where a residual charge remaining on the photosensitive member surface is present, the residual charge may preferably be erased or removed by pre-exposure means (not shown) after the cleaning step. On the other hand, the transfer-receiving material 8 having thereon the toner image is conveyed to fixing means 9 though a conveyance part (not shown), where the toner image is fixed.

As a light source of the imagewise exposure light 4, those emitting halogen light or laser light and a fluorescent lamp may be used.

The above-described image-forming process may optionally include another auxiliary step, as desired.

In the present invention, the photosensitive member 2 and the charging member 1 may be integrally supported to form a process cartridge 10 which is detachably mountable to an electrophotographic apparatus main body as shown in FIG. 2. Such a process cartridge 10 may also include the developing means 5 and the cleaning means 7.

Further, the electrophotographic apparatus of the present invention may be designed to a so-called cleaner-less apparatus omitting the cleaning means 7. In this case, the cleaning operation is substantially performed by the magnetic brush as the charging member 1.

Hereinbelow, the present invention will be described more specifically with reference to examples.

EXAMPLE 1

On an aluminum cylinder (Al—Mn based aluminum alloy according to JIS A3003; 30 mm×260.5 mm), a 8 $\mu$m-thick surface-oxidized film was formed in the following manner.

The aluminum cylinder was washed by degreasing, etching with a 2 wt. %-sodium hydroxide solution, neutralization and pure water treatment in this order.

The thus-cleaned aluminum cylinder was subjected to anodizing with a 10 wt. %-sulfuric acid solution at a current density of 1.5 A/dm$^2$ to form an anodic oxide film on the surface of the aluminum cylinder.

After washing with water, the above-treated aluminum cylinder was subjected to a pore-filling treatment by immersing it in a 1 wt. %-nickel acetate solution for 15 minutes at 80° C. to fill minute pores of the anodic oxide film, followed by washing with water and drying to obtain an aluminum support including the surface-oxidized film.

The thus-prepared aluminum support showed a work function (Wf) of 5.62 eV.

Then, 4 wt. parts of oxytitanium phthalocyanine Bragg angles (2θ±0.2 degree) of 9.0 degrees, 14.2 degrees, 23.9 degrees and 24.1 degrees in X-ray diffraction pattern based on CuKα characteristic X-ray) represented by the following formula:

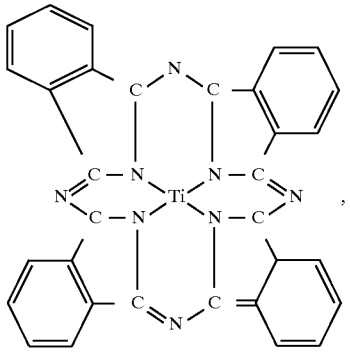

2 wt. parts of polyvinyl butyral ("S-LEC BX-1", mfd. by Sekisui Kagaku Kogyo K.K.) and 80 wt. parts of cyclohexanone were dispersed for 4 hours in a sand mill using 1 mmø-glass beads, followed by addition of 100 wt. parts of ethyl acetate.

The dispersion was applied onto the aluminum cylinder (at its surface where the surface-oxidized film was formed) to form a 0.25 μm-thick charge generation layer.

Thereafter, 10 wt. parts of styryl compound of the following formula:

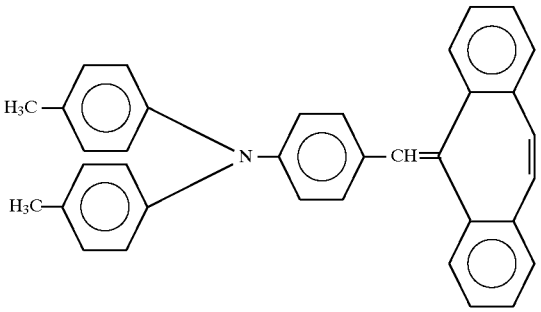

and 10 wt. parts of bisphenol Z-type polycarbonate ("Z-200", mfd. by Mitsubishi Gas Kagaku Kogyo K.K.) were dissolved in 100 wt. parts of chlorobenzene.

The solution was applied onto the charge generation layer and dried for 1 hour at 105° C. to form a 20 μm-thick charge transport layer.

Then, 25 wt. parts of an acrylic monomer of the following formula:

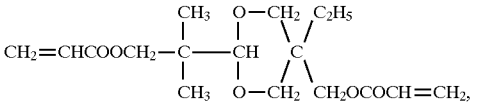

50 wt. parts of antimony-doped tin oxide particles (number-average particle size (Dn)=0.2 μm) treated with a surface-treating agent (7 wt. % based on the tin oxide) of the following formula:

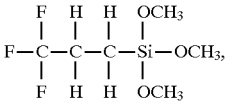

20 wt. parts of tetrafluoroethylene resin particles (Dn=0.18 μm), 15 wt. parts of 2-methyl thioxanthone, and 150 wt. parts of ethanol were dispersed for 66 hours in a sand mill.

The dispersion was applied onto the charge transport layer and subjected to photo-curing for 60 sec. at a light intensity of 150 W/cm$^2$ by using a high-pressure mercury vapor lamp, followed by drying for 2 hours at 120° C. to form a 3 μm-thick surface layer, thus preparing an electrophotographic photosensitive member.

The surface layer showed a volume resistivity (Rv) of $4.5\times10^{12}$ ohm.cm.

Separately, coated-magnetic particles for a charging member were prepared by mixing Zn—Cu ferrite particles (Dn=25 μm) with Zn—Cu ferrite particles (Dn=10 μm) in a weight ratio of 1:0.05 to prepare Zn—Cu ferrite particles (Dn=25 μm) having a particle size distribution including two peaks at positions corresponding to 25 μm and 10 μm and coating the mixture ferrite particles with a medium-resistance resin layer. The medium-resistance layer was formed by using a solution of polycarbonate resin in which titanium oxide particles and tetrafluoroethylene resin particles were dispersed.

A charging member comprised coated magnetic particles prepared above, a non-magnetic sleeve supporting the coated-magnetic particles, and a magnet roller enclosed within the sleeve. The magnetic particles were applied in an initial thickness of ca. 1 mm so as to form a magnetic brush forming a contact nip in a width of ca. 5 mm with the photosensitive member. The magnetic particle-holding sleeve was initially disposed with a gap of ca. 500 μm from the photosensitive member. The magnetic roller was held immovably within the sleeve, and the sleeve surface was caused to move at a speed twice the peripheral speed and in a reverse direction with the rotation of the photosensitive member, so as to cause a uniform contact between the photosensitive member and the magnetic brush.

The charging member showed a resistance of $5\times10^5$ ohm.

After the above-prepared photosensitive member and the charging member were incorporated in a laser beam printer ("LBP-NX", mfd. by Canon K.K.), a (dark-part) surface potential (Vd) of the photosensitive member immediately after primary charging at an initial stage (for ca. 1st to 50th sheets) was measured under application of an applied voltage for primary charging including a DC voltage of −700 volts superposed with an AC voltage with a peak-to-peak voltage (Vpp) of 1000 volts and a frequency of 1 kHz. The Vpp was smaller than a value twice the threshold voltage (Vth=580 volts).

Further, by using the laser beam printer, 1000 sheets (A4-sized) of image formation was effected at an intermittent mode (pause period=1 sec.) for each sheet to evaluate image quality by eyes at an initial stage (for ca. 1st to 50th sheets) and after 1000 sheets of image formation. The image to be formed on each A4-sheet comprised a halftone image consisting of one dot-wide solid lines and two dot-wide blank spaces therebetween alternately arranged in a direction perpendicular to the longitudinal direction of the A4 sheet.

The results are shown in Table 1 appearing hereinafter.

Evaluation standards for image quality were as follows.

A: Good halftone image was confirmed.

A': The resultant image was somewhat accompanied with a fog but is at a practically acceptable level.

B: Image blur occurred (practically unacceptable level).

C: Fog occurred (practically unacceptable level).

EXAMPLES 2 and 3

Photosensitive members were prepared and evaluated in the same manner as in Example 1 except that the addition amount (25 wt. parts) of the acrylic monomer was changed to 20 wt. parts (Ex. 2) and 17 wt. parts (Ex. 3), respectively.

The results are shown in Table 1.

Comparative Examples 1–3

Photosensitive members were prepared and evaluated in the same manner as in Example 1 except that the addition amount (25 wt. parts) of the acrylic monomer was changed to 40 wt. parts (Comp. Ex. 1), 30 wt. parts (Comp. Ex. 2) and 10 wt. parts (Comp. Ex. 3), respectively.

The results are shown in Table 2 appearing hereinafter.

EXAMPLES 4–6

Photosensitive members were prepared and evaluated in the same manner as in Example 1 except that the amount (7 wt. %) of the surface-treating agent was changed to 4 wt. % (Exs. 4–6) and that the addition amount (25 wt. parts) of the acrylic monomer was changed to 30 wt. parts (Ex. 4), 25 wt. parts (unchanged for Ex. 5), and 20 wt. parts (Ex. 6), respectively.

The results are shown in Table 1.

Comparative Examples 4–6

Photosensitive members were prepared and evaluated in the same manner as in Examples 4–6 except that the addition amounts of the acrylic monomer were changed to 40 wt. parts (Comp. Ex. 4), 35 wt. parts (Comp. Ex. 5) and 15 wt. parts (Comp. Ex. 6), respectively.

The results are shown in Table 2.

EXAMPLES 7 and 8

Photosensitive members were prepared and evaluated in the same manner as in Example 1 except that the thickness (8 $\mu$m) of the surface-oxidized film was changed to 3 $\mu$m (Ex. 7) and 10 $\mu$m (Ex. 8), respectively.

The results are shown in Table 1.

Comparative Example 7

A photosensitive member was prepared and evaluated in the same manner as in Example 1 except that the anodizing and pore-filling treatment of the aluminum cylinder were not performed.

The results are shown in Table 2.

EXAMPLES 9–11

Photosensitive members were prepared and evaluated in the same manner as in Examples 1, 7 and 8 (for Exs. 9, 10 and 11, respectively) except that the pore-filling treatment was not performed.

The results are shown in Table 1.

EXAMPLE 12

A photosensitive member was prepared and evaluated in the same manner as in Example 1 except that the current density (1.5 A/dm$^2$) of the anodizing was changed to 0.1 A/dm$^2$.

The results are shown in Table 1.

EXAMPLE 13

A photosensitive member was prepared and evaluated in the same manner as in Example 1 except that the concentration (10 wt. %) of the sulfuric acid solution in the anodizing was changed to 1 wt. %.

The results are shown in Table 1.

EXAMPLE 14

A photosensitive member was prepared and evaluated in the same manner as in Example 1 except that the cleaned aluminum cylinder was subjected to the following chemical oxidation treatment instead of the anodizing and pore-filling treatment.

The cleaned aluminum cylinder was immersed in pure water containing 5 wt. %-phosphoric acid, 1 wt. %-chromic acid and 0.5 wt. %-hydrofluoric acid for 5 minutes at 60° C.

The results are shown in Table 1.

EXAMPLES 15 and 16

Photosensitive members were prepared and evaluated in the same manner as in Example 14 except that the addition amount (25 wt. parts) of the acrylic monomer was changed to 20 wt. parts (Ex. 15) and 17 wt. parts (Ex. 16), respectively.

The results are shown in Table 1.

Comparative Examples 8–10

Photosensitive members were prepared and evaluated in the same manner as in Example 14 except that the addition amount (25 wt. parts) of the acrylic monomer was changed to 40 wt. parts (Comp. Ex. 8), 30 wt. parts (Comp. Ex. 9) and 10 wt. parts (Comp. Ex. 10), respectively.

The results are shown in Table 2 appearing hereinafter.

EXAMPLES 17–19

Photosensitive members were prepared and evaluated in the same manner as in Example 14 except that the amount (7 wt. %) of the surface-treating agent was changed to 4 wt. % (Exs. 17–19) and that the addition amount (25 wt. parts) of the acrylic monomer was changed to 30 wt. parts (Ex. 17), 25 wt. parts (unchanged for Ex. 18), and 20 wt. parts (Ex. 19), respectively.

The results are shown in Table 1.

Comparative Examples 11–13

Photosensitive members were prepared and evaluated in the same manner as in Examples 17–19 except that the addition amounts of the acrylic monomer were changed to 40 wt. parts (Comp. Ex. 11), 35 wt. parts (Comp. Ex. 12) and 15 wt. parts (Comp. Ex. 13), respectively.

The results are shown in Table 2.

EXAMPLE 20

A photosensitive member was prepared and evaluated in the same manner as in Example 14 except that the treating temperature (60° C.) of the treatment was changed to 25° C.

The results are shown in Table 1.

EXAMPLE 21

A photosensitive member was prepared and evaluated in the same manner as in Example 14 except that the immersion time (5 min.) of the aluminum cylinder was changed to 1 min.

The results are shown in Table 1.

TABLE 1

| Ex. No. | Treating | Pore-filling | Wf (eV) | Film thickness (μm) | Rv (ohm · cm) | Vd (−V) | Image Initial | Image After $10^3$ sheets |
|---|---|---|---|---|---|---|---|---|
| 1 | Anodizing | Yes | 5.62 | 8 | $4.5 \times 10^{12}$ | 680 | A | A |
| 2 | | " | 5.62 | 8 | $1.0 \times 10^{12}$ | 690 | " | " |
| 3 | | " | 5.62 | 8 | $5.0 \times 10^{11}$ | 695 | " | " |
| 4 | | " | 5.62 | 8 | $4.0 \times 10^{12}$ | 685 | " | " |
| 5 | | " | 5.62 | 8 | $9.0 \times 10^{11}$ | 690 | " | " |
| 6 | | " | 5.62 | 8 | $1.0 \times 10^{11}$ | 695 | " | " |
| 7 | | " | 5.58 | 3 | $4.5 \times 10^{12}$ | 670 | " | " |
| 8 | | " | 5.70 | 10 | $4.5 \times 10^{12}$ | 690 | " | " |
| 9 | | No | 5.59 | 8 | $4.5 \times 10^{12}$ | 680 | " | " |
| 10 | | " | 5.55 | 3 | $4.5 \times 10^{12}$ | 670 | " | " |
| 11 | | " | 5.64 | 10 | $4.5 \times 10^{12}$ | 690 | " | " |
| 12 | | Yes | 4.90 | 1.2 | $4.5 \times 10^{12}$ | 690 | " | A' |
| 13 | | " | 4.73 | 1.0 | $4.5 \times 10^{12}$ | 695 | " | A' |
| 14 | Chemical oxidation | " | 5.51 | 1.5 | $4.5 \times 10^{12}$ | 680 | " | A |
| 15 | | " | 5.51 | 1.5 | $1.0 \times 10^{12}$ | 685 | " | " |
| 16 | | " | 5.51 | 1.5 | $5.0 \times 10^{11}$ | 690 | " | " |
| 17 | | " | 5.51 | 1.5 | $4.0 \times 10^{12}$ | 680 | " | " |
| 18 | | " | 5.51 | 1.5 | $9.0 \times 10^{11}$ | 685 | " | " |
| 19 | | " | 5.51 | 1.5 | $1.0 \times 10^{11}$ | 690 | " | " |
| 20 | | " | 4.64 | 0.1 | $4.5 \times 10^{12}$ | 695 | " | A' |
| 21 | | " | 4.92 | 0.2 | $4.5 \times 10^{12}$ | 690 | " | A' |

TABLE 2

| Comp. Ex. No. | Treating | Pore-filling | Wf (eV) | Film thickness (μm) | Rv (ohm · cm) | Vd (−V) | Image Initial | Image After $10^3$ sheets |
|---|---|---|---|---|---|---|---|---|
| 1 | Anodizing | Yes | 5.62 | 8 | $7.0 \times 10^{15}$ | 660 | C | — |
| 2 | | " | 5.62 | 8 | $3.0 \times 10^{15}$ | 670 | C | — |
| 3 | | " | 5.62 | 8 | $5.0 \times 10^{9}$ | 700 | B | — |
| 4 | | " | 5.62 | 8 | $6.0 \times 10^{15}$ | 660 | C | — |
| 5 | | " | 5.62 | 8 | $2.0 \times 10^{15}$ | 675 | C | — |
| 6 | | " | 5.62 | 8 | $6.0 \times 10^{9}$ | 700 | B | — |
| 7 | None | — | — | — | $4.5 \times 10^{12}$ | 680 | C | — |
| 8 | Chemical oxidation | Yes | 5.51 | 1.5 | $7.0 \times 10^{15}$ | 660 | C | — |
| 9 | | " | 5.51 | 1.5 | $3.0 \times 10^{15}$ | 650 | C | — |
| 10 | | " | 5.51 | 1.5 | $5.0 \times 10^{9}$ | 680 | B | — |
| 11 | | " | 5.51 | 1.5 | $6.0 \times 10^{15}$ | 660 | C | — |
| 12 | | " | 5.51 | 1.5 | $2.0 \times 10^{15}$ | 665 | C | — |
| 13 | | " | 5.51 | 1.5 | $6.0 \times 10^{9}$ | 640 | B | — |

What is claimed is:

1. An electrophotographic apparatus, comprising: an electrophotographic photosensitive member, a charging member, developing means and transfer means; said charging member being disposed contactable to the photosensitive member and supplied with a voltage so as to charge the photosensitive member, wherein said photosensitive member comprises a metal support, a photosensitive layer disposed on the support, and a surface layer disposed on the photosensitive layer, said surface layer has a volume resistivity of $1\times10^{10}$–$1\times10^{15}$ ohm.cm, and said metal support has a surface-oxidized film at its surface provided with the photosensitive layer.

2. An apparatus according to claim 1, wherein said metal support has a work function of 5.0–6.5 eV.

3. An apparatus according to claim 2, wherein said work function is 5.5–6.0 eV.

4. An apparatus according to claim 1, wherein said metal support comprises aluminum.

5. An apparatus according to claim 1, wherein said surface layer has a volume resistivity of $1\times10^{11}$–$1\times10^{14}$ ohm.cm.

6. An apparatus according to claim 5, wherein said volume resistivity is $1\times10^{11}$–$5\times10^{12}$ ohm.cm.

7. An apparatus according to claim 1, wherein the charging of the photosensitive member by said charging member comprises injection charging.

8. An apparatus according to claim 1, wherein the charging of the photosensitive member by said charging member comprises charging substantially free from discharge.

9. An apparatus according to claim 1, wherein said voltage supplied to said charging member comprises a DC voltage superposed with an AC voltage, said charging member imparting a surface potential which is at least 80% of the DC voltage to the photosensitive member.

10. A process cartridge, comprising: an electrophotographic photosensitive member, and charging member disposed contactable to the photosensitive member and supplied with a voltage so as to charge the photosensitive member, wherein said photosensitive member comprises a metal support, a photosensitive layer disposed on the support, and a surface layer disposed on the photosensitive layer, said surface layer has a volume resistivity of $1\times10^{10}$–$1\times10^{15}$ ohm.cm, said metal support has a surface-oxidized film at its surface provided with the photosensitive layer, and said photosensitive member and said charging member are integrally supported to form a cartridge which is detachably mountable to an electrophotographic apparatus.

11. A cartridge according to claim 10, wherein said metal support has a work function of 5.0–6.5 eV.

12. A cartridge according to claim 11, wherein said work function is 5.5–6.0 eV.

13. A cartridge according to claim 10, wherein said metal support comprises aluminum.

14. A cartridge according to claim 10, wherein said surface layer has a volume resistivity of $1\times10^{11}$–$1\times10^{14}$ ohm.cm.

15. A cartridge according to claim 14, wherein said volume resistivity is $1\times10^{11}$–$5\times10^{12}$ ohm.cm.

16. A cartridge according to claim 10, wherein the charging of the photosensitive member by said charging member comprises injection charging.

17. A cartridge according to claim 10, wherein the charging of the photosensitive member by said charging member comprises charging substantially free from discharge.

18. A cartridge according to claim 10, wherein said voltage supplied to said charging member comprises a DC voltage superposed with an AC voltage, said charging member imparting a surface potential which is at least 80% of the DC voltage to the photosensitive member.

* * * * *

UNITED STATES PATENT AND TRADEMARK OFFICE

CERTIFICATE OF CORRECTION

PATENT NO. : 5,875,375

DATED : February 23, 1999

INVENTOR(S) : HIROYUKI OHMORI, ET AL.

It is certified that error appears in the above-identified patent and that said Letters Patent is hereby corrected as shown below:

COLUMN 1,
Line 11, "cleaning;" should read --cleaning,--.

COLUMN 2,
Line 19, "damage" should read --damaging--.
Line 47, "extent" should read --extent of--.
Line 60, "an" should read --a--.

COLUMN 3,
Line 66, "ai" should read --a--.

COLUMN 7,
Line 16, "These" should read --This--.
Line 21, "resisttance" should read --resistance--.

COLUMN 8,
Line 43, "a 8" should read --an 8--.

UNITED STATES PATENT AND TRADEMARK OFFICE

CERTIFICATE OF CORRECTION

PATENT NO. : 5,875,375

DATED : February 23, 1999

INVENTOR(S) : HIROYUKI OHMORI, ET AL.

It is certified that error appears in the above-identified patent and that said Letters Patent is hereby corrected as shown below:

COLUMN 9,
Formula 1, replace as follows:

"

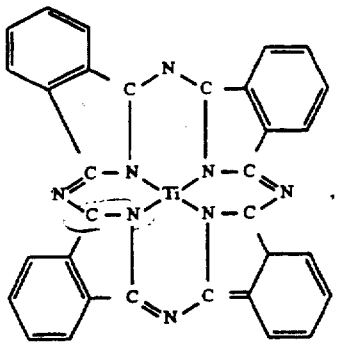

"

should read

--

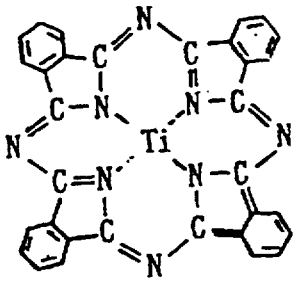

--.

UNITED STATES PATENT AND TRADEMARK OFFICE

CERTIFICATE OF CORRECTION

PATENT NO. : 5,875,375

DATED : February 23, 1999

INVENTOR(S) : HIROYUKI OHMORI, ET AL.

It is certified that error appears in the above-identified patent and that said Letters Patent is hereby corrected as shown below:

COLUMN 10,
Line 50, "lines" should read --line--.

Signed and Sealed this

Twenty-third Day of May, 2000

*Attest:*

Q. TODD DICKINSON

*Attesting Officer*

*Director of Patents and Trademarks*